US006405874B1

(12) United States Patent
Douglas

(10) Patent No.: US 6,405,874 B1
(45) Date of Patent: Jun. 18, 2002

(54) MOBILE MATERIAL HANDLING APPARATUS WITH LOWERABLE TRACK SET

(75) Inventor: Patrick Joseph Douglas, Castletown (GB)

(73) Assignee: Rose Holdings Limited (KN)

( * ) Notice: Subject to any disclaimer, the term of this patent is extended or adjusted under 35 U.S.C. 154(b) by 0 days.

(21) Appl. No.: 09/710,096

(22) Filed: Nov. 10, 2000

(51) Int. Cl.[7] ..... B07B 1/49

(52) U.S. Cl. ..... 209/421; 209/241; 209/244; 209/257

(58) Field of Search ..... 209/240, 241, 209/243, 244, 255, 257, 420, 421

(56) References Cited

U.S. PATENT DOCUMENTS

| | | | | |
|---|---|---|---|---|
| 5,577,618 A | * | 11/1996 | Rafferty | 209/421 |
| 5,921,706 A | | 7/1999 | Manatt et al. | 404/72 |

FOREIGN PATENT DOCUMENTS

| | | | | |
|---|---|---|---|---|
| CA | 2085321 | | 6/1993 | |
| DE | 19600897 | | 4/1997 | |
| DE | 29810885 U | | 8/1998 | |
| DE | 19805378 | | 8/1999 | |
| GB | 1553667 | * | 10/1979 | 209/421 |
| JP | 3-102002 | * | 4/1991 | 209/421 |
| WO | WO 95/12462 | | 5/1995 | |
| WO | WO 99/49976 | | 10/1999 | |

* cited by examiner

*Primary Examiner*—Tuan N. Nguyen
(74) *Attorney, Agent, or Firm*—Madson & Metcalf

(57) ABSTRACT

A mobile material handling apparatus (10) having a frame (11), an input arrangement (13) for receiving a bulk supply of raw material to be handled, a screen box (16) or other material processing device, a conveyor (17) to transfer the material from the input arrangement (13) to the material processing device (16), one or more discharge conveyors (14, 15) to discharge the processed material, and a wheel set (12) supporting the frame (11) to render the apparatus mobile e.g. to be transported along the public highway via a fifth wheel coupling or low loader. In order to provide the apparatus with a capability of being manoeuvred on site, a set of endless tracks (20) is mounted on the apparatus frame (11) and is adjustable between an inoperative condition out of contact with the ground, and an operative ground-engaging position when it is required to manoeuvre the apparatus on site.

12 Claims, 2 Drawing Sheets

MOBILE MATERIAL HANDLING APPARATUS WITH LOWERABLE TRACK SET

This invention relates to a mobile material handling apparatus which comprises a frame, an input arrangement for receiving a bulk supply of raw material to be handled, means mounted on the frame to transfer material from the input arrangement to a discharge arrangement, and a wheel set supporting the frame to render the apparatus mobile.

A material handling apparatus according to the invention has been developed primarily (though not exclusively) in connection with the processing of a bulk supply of material which requires to be separated or "screened" into at least two separate portions or fractions. The separate portions could comprise undesired material on the one hand, and one (or more) screened portions of desired material in a predetermined size range. Alternatively, all of the bulk supply of raw material could be desired material, and the function of the apparatus then is to screen the raw material into two or more different size ranges.

However, while the invention is particularly applicable to a material processing equipment (in which the "processing" can include crushing and/or shredding of the bulk supply of raw material and/or screening of the material into one or more size range), the invention also contemplates simpler type of mobile material handling apparatus, and which has an input arrangement to receive a bulk supply of raw material, a discharge arrangement, and one or more conveyor or transfer means to transfer the material between the input and the discharge arrangement.

BACKGROUND TO THE INVENTION

In a stone quarry installation, it is known to use a large screening plant, which receives a crushed supply of rock material and which separates the material into different size ranges, and then discharges the screened material to separate discharge points to form progressively increasing stockpiles of material.

In some installations, a screening plant is a substantially permanent fixture, and which is assembled on site, but which is not capable of being rapidly dismantled on site for subsequent transport to another site and subsequent re-erection. Therefore, although in theory a so-called permanent screening plant could be dismantled, transported onto a low loader to another site and then re-erected, in practice this generally does not happen. Furthermore, on a particularly large quarry site, it may be desirable to move a screening plant from one place to another as quarrying proceeds, and permanent screening plant fixtures cannot be utilised to meet this potential need.

Accordingly, to provide a facility for screening plant to be moved from one site to another (including transport along the public highway), or to be moved a short distance on any particular site, it is known to provide mobile screening plants with at least one wheel set to support part of the frame of the plant, and which can be converted fairly quickly between an operative (screening) mode and a transport mode. Given the fact that screening plants generally are of substantial overall size, and typically have a number of lengthy transfer conveyors to transfer material from one processing and/or handling device to another, and also usually have laterally projecting discharge conveyors to form separate stockpiles alongside the plant, considerable ingenuity is required in designing the components of the plant, so as to make it a relatively straightforward and non-skilled, and also rapid task to convert the plant components between operative (deployed) positions and transport positions.

Reference may be had, by way of example only, to known designs of mobile material processing plant, as disclosed in EP 0506812, EP 0407549, EP0726818 and EP 0301798.

Upon conversion of existing designs of mobile plant to a transport mode, it is usual for the forward end of the plant to be mounted on a low loader, or on a fifth wheel coupling, and the remainder of the plant then can be towed along the public highway, utilising one or more wheel set which supports the remainder of the frame of the plant. However, while this is satisfactory in moving a plant substantial distances from one quarry site to another, it is not suitable for small movement within an existing quarry site, and especially when turning space is restricted, or there is little free space available for manoeuvre.

SUMMARY OF THE INVENTION

The present invention has therefore been developed primarily with a view to provide improved manoeuvrability on site to a mobile material handling apparatus of a type which is capable of being converted readily to a transport mode for being towed along the public highway a substantial distance from one site to another.

According to the invention there is provided a mobile material handling apparatus which comprises a frame, an input arrangement for receiving a bulk supply of raw material to be handled, means to transfer the material from the input arrangement to a discharge arrangement, and a wheel set supporting the frame to render the apparatus mobile; in which a set of endless tracks is mounted on the frame and which is adjustable between an inoperative condition out of contact with the ground and an operative ground-engaging position when it is required to manoeuvre the apparatus on site.

The wheel set supports part of the frame of the apparatus, and allows the apparatus to be manoeuvred through small distances on site when the set of endless tracks is adjusted to the operative condition. However, when the track set is adjusted to the inoperative condition, the frame of the apparatus may have additional ground support e.g. additional support legs, which allow the apparatus to carry out required material handling operations at a particular position on site. However, when it is required to transport the apparatus a substantial distance from one site to another, the frame of the apparatus may be coupled to a low loader or a fifth wheel coupling, to enable the apparatus to be towed like a trailer with the wheel set supporting the remainder of the frame (and with the set of endless tracks adjusted to the inoperative condition).

The endless track set may be movably mounted on the frame to be adjusted between a raised inoperative position, and a lowered operative position.

In order to assist the manoeuvrability of the apparatus, it is preferred that the frame of the endless track set is connected to the frame of the apparatus via a swivel mounting e.g. a centrally located pivot on the frame of the endless track set.

The input arrangement may comprise a simple supply chute or hopper to receive a bulk supply of raw material, and a conveyor may run from the input arrangement to a screen box which screens the material into different size range(s), the or each of which can be discharged via a respective discharge conveyor, which is preferably adjustable between a folded transport position, and an outwardly extending or deployed operative position.

The input arrangement may include a preliminary screening function e.g. to discharge undesired material. such as tree roots and branches, or rubble, if the raw material supply is site clearance material.

The input arrangement may also include a crusher and/or shredder machine to carry out required material processing action, prior to screening equipment.

A preferred embodiment of mobile material handling apparatus will now be described in detail, by way of example only, with reference to the accompanying drawings.

DESCRIPTION OF PREFERRED EMBODIMENT

Figure 1:
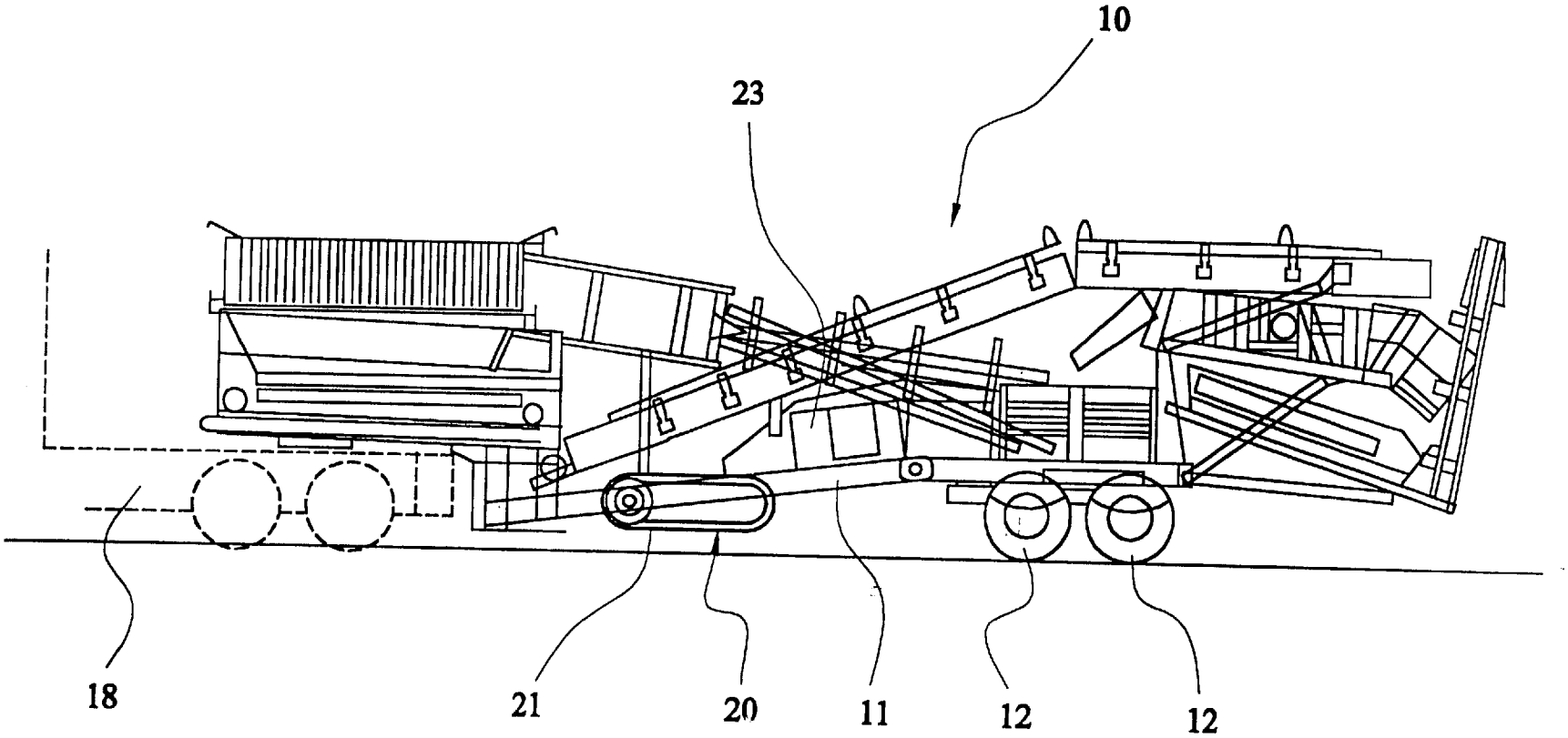
FIG. 1 is a side view of a mobile material handling apparatus, in the form of a material processing and screening apparatus, and after adjustment of the components thereof to a transport mode, ready for being towed along the public highway via a tractor unit including a low loader or fifth wheel coupling.

Referring now to the drawings, the preferred embodiment of the invention which will be described is a material processing apparatus, which has equipment capable of processing a bulk supply of raw material, and also of screening the processed material into one or more different size ranges. However, it is within the scope of the invention to provide a simplified apparatus, which merely handles a supply of bulk material, and which transfers the material from an input arrangement to a discharge arrangement, and having a frame supported by a wheel set to render the apparatus mobile.

Figure 2:
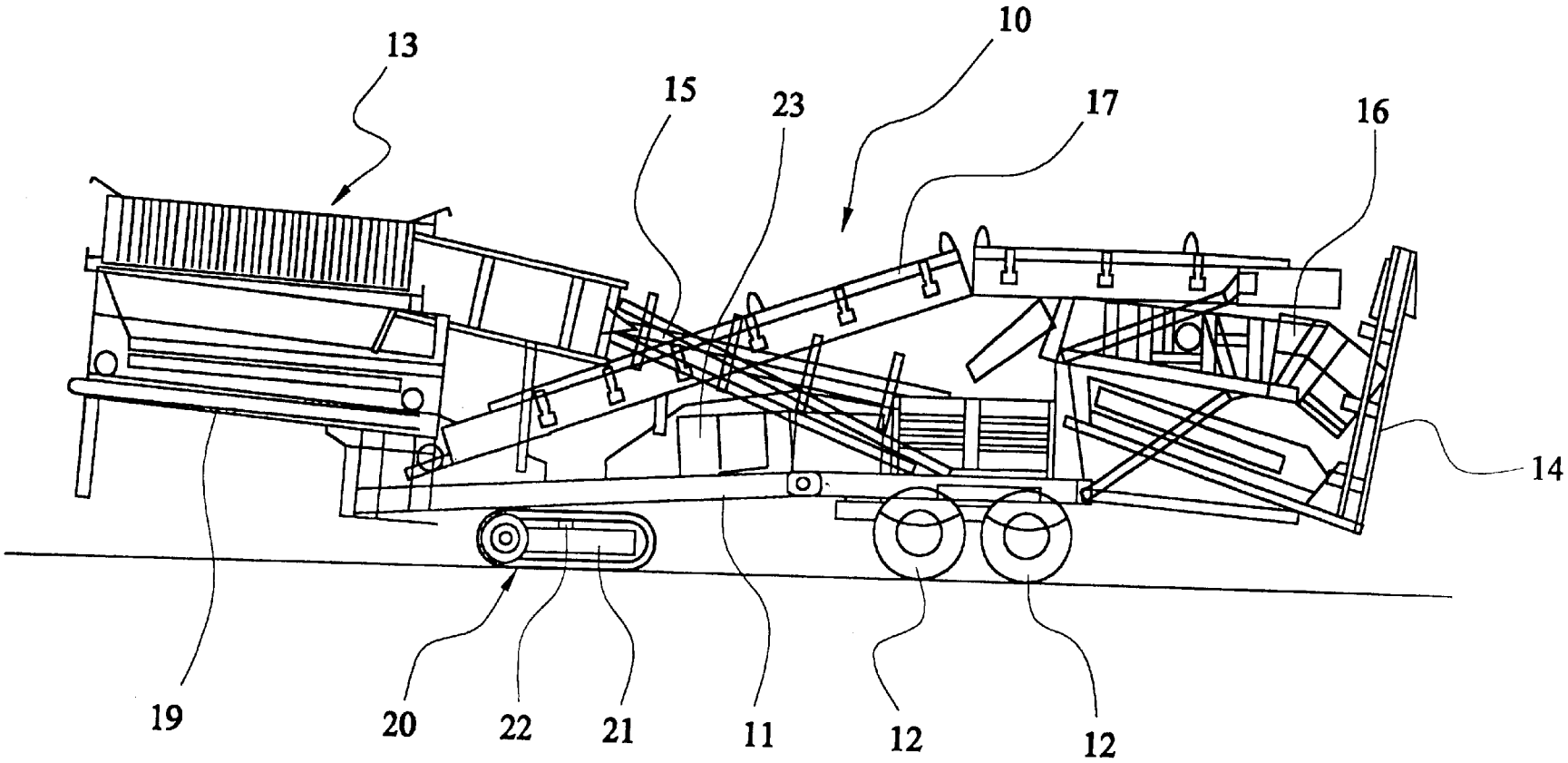
FIG. 2 is a view, similar to FIG. 1, but showing the apparatus adjusted whereby a lowerable endless track set is in contact with the ground, and which can be operated in order to manoeuvre the apparatus small distances on site.

The embodiment of apparatus according to the invention, as shown in FIGS. 1 and 2, is designated generally by reference 10, and comprises a main frame or chassis 11, and one or more wheel set 12 which supports part of the frame 11, and which in the illustrated arrangement comprises support for the rear end of the frame 11.

The frame 11 carries or supports, at its forward end, an input arrangement designated generally by reference 13, and which receives a bulk supply of raw material to be handled, which can include quarried stone, or site clearance material. Transfer means (17) is provided to transfer the material from the input arrangement 13 to a discharge arrangement, and which, in the illustrated embodiment, comprises a number of separate discharge conveyors 14 and 15, which are shown in their inoperative and transport positions. Discharge conveyor 14 is a so-called "tail conveyor", whereas discharge conveyor 15 is a side conveyor, which is capable of being pivoted to an outwardly and upwardly extending position, in order to discharge a screened portion onto a stockpile to one side of the apparatus.

A screen box 16 is mounted on the frame 11, and receives a supply of material from the input arrangement 13 via the transfer means 17, which in the illustrated arrangement is a supply conveyor or elevator 17, which comprises two parts hinged together (and shown in a pivoted transport position), and which are adjustable to an in-line position (not shown) in which material can be elevated from the discharge arrangement 13 and then fall from the upper end of the elevator into the screen box 16, to be separated out into separate screened fractions, one size range of which passes to the tail conveyor 14, and another screened portion which passes to the side conveyor 15, when these conveyors are deployed to their discharge positions.

The construction and arrangement of the tail conveyor 14 and side conveyor 15 maybe as disclosed in more detail in published E.P. 0506812 and 0726818.

FIG. 1 shows the apparatus 10 after adjustment to a transport mode, in which the apparatus can be towed substantial distance along the public highway, to move from one site to another. The forward end of the frame 11 is supported on a low loader 18, or on any suitable load platform, and preferably via a fifth wheel coupling, although this is not shown in detail in FIG. 1.

As shown in FIG. 1, the entire input arrangement assembly 13, which comprises a large box like structure, is mounted via its lower surface onto the load platform, and the input arrangement 13 may include a guide chute or hopper, and, if desired, crusher and/or shredder equipment to apply initial processing to the bulk supply of raw material. The input arrangement may include grizzly bars or other coarse screen arrangement to separate undesired material, such as excessively large rubble or tree roots or branches.

As can be seen in FIGS. 1 and 2, a set of endless tracks 20 is mounted on the frame 11 and is adjustable between an inoperative condition out of contact with the ground, as shown in FIG. 1, and an operative ground-engaging position when it is required to manoeuvre the apparatus on site, as shown in FIG. 2. The wheel set(s) 12 therefore support part of the frame 11 of the apparatus 10, and allow the apparatus to be manoeuvred through small distances on site when the track set 20 is adjusted to the operative condition. However, when the track set 20 is adjusted to the inoperative condition, as shown in FIG. 1, the frame 11 of the apparatus may have additional ground support e.g. by use of adjustable support legs, which can allow the apparatus to carry out required material handling operations at any particular position on a site. Alternatively, the track set 20 can be adjusted to the lowered position, and act as a support for the forward end of the frame 11, but not being operated, so that the apparatus can then function to carry out the required material handling operations.

However, when it is required to transport the apparatus 10 a substantial distance, from one site to another, then the track set 20 is raised to the inoperative condition shown in FIG. 1, and the apparatus 10 can therefore be towed like a trailer, with the wheel set(s) 12 supporting the rear end of the frame.

In the illustrated arrangement, the endless track set 20 is adjustably mounted on the frame 11 by being movable between a raised inoperative position, and a lowered operative position i.e. a chassis 21 carrying the track set 20 is adjustable up and down relative to the main frame 11. In order to assist the manoeuvrability of the apparatus, the chassis 21 of the endless track set 20 is connected to the frame 11 via a swivel mounting 22, and which may comprise a centrally provided pivot.

However, in an alternative arrangement, the chassis 21 (frame) of the track set 20 can be fixedly mounted on the main frame 11 via an adjustable frame portion of the main frame.

In a further preferred arrangement (within the scope of the invention) the mounting of the wheelset 12 and the fifth wheel coupling 19 are effectively reversed. This is not shown, but the wheelset 12 will support the input arrangement 13 (hopper), and the fifth wheel coupling 19 will be arranged to support the screening portion of the apparatus i.e. to support the screen box (and optionally also the related discharge conveyors).

Although not shown in detail, the frame 11 of the apparatus may have a power pack 23 mounted thereon, to provide power to drive the operating components of the apparatus (conveyors, screen, and set of tracks).

The apparatus may have a driver/operator's cab (not shown) from which the operation of the apparatus can be controlled. Alternatively, the apparatus may be arranged to be operated by remote control e.g. via an umbilical, radio or infra red control e.g. from the cab of a loading vehicle supplying bulk material to the apparatus.

I claim:

1. A mobile material handling apparatus which has a towing mode and which is also adjustable to a self-propelled mode, said apparatus comprising:

a frame extending lengthwise of the apparatus and having a forward end and a rearward end;

an input arrangement at the forward end of the frame and having a receiving hopper arranged above the ground to receive a bulk supply of raw material to be handled, when the apparatus is adjusted to its self-propelled mode;

a material processing device mounted on the frame;

transfer means for transferring material from the input arrangement to the material processing device;

a discharge conveyor mounted on the frame and arranged to discharge processed material from the material processing device;

a wheel set permanently supporting the rear end of the frame to render the apparatus mobile, both in the towing mode and in the self-propelled mode;

a coupler located below the input arrangement and which enables the apparatus to be coupled with a tractor vehicle to be towed thereby, when in the towing mode; and a single endless track set mounted on the frame, near the forward end of the frame, and which is short in length relative to the overall length of the frame, said track set being engageable with the ground when the apparatus is uncoupled from the tractor vehicle and being operative to render the apparatus self-propelled when manoeuvring of the apparatus on site is required.

2. Apparatus according to claim 1, in which the endless track set is movably mounted on the frame to move between a raised inoperative position, and a lowered operative position.

3. Apparatus according to claim 1, in which the endless track set is mounted on an adjustable portion of the frame.

4. Apparatus according to claim 2, in which the endless track set is connected to the frame of the apparatus via a swivel mounting.

5. Apparatus according to claim 1, in which the input arrangement is configured to be mounted on a fifth wheel coupling, to allow the apparatus to be towed from one site to another, when the endless track set is adjusted to the inoperative condition.

6. Apparatus according to claim 1, in which the input arrangement is configured to be mounted on a tow-hitch or a loading platform.

7. Apparatus according to claim 1, in which the input arrangement includes means for crushing and/or shredding the supply of raw material, to carry out initial processing of the material.

8. Apparatus according to claim 1, and including a screen box mounted on the frame, and operative to separate the bulk material into one or more ranges of screened sizes.

9. Apparatus according to claim 1, in which the transfer means comprises a foldable supply elevator for supplying material from the input arrangement to discharge arrangement, including one or more discharge conveyors to discharge respective size ranges of a screened material.

10. Apparatus according to claim 8, in which the wheel set is arranged to support a portion of the frame on which the screen box is mounted.

11. Apparatus according to claim 8, in which a fifth wheel coupling is arranged to support a portion of the frame on which a screening device is mounted.

12. Apparatus according to claim 11, in which the wheel set is arranged to support the input arrangement of the apparatus.

* * * * *